US006212694B1

(12) United States Patent
Porzio

(10) Patent No.: US 6,212,694 B1
(45) Date of Patent: Apr. 10, 2001

(54) TOILET ACCESSORY

(76) Inventor: Thomas Porzio, 1316 Deans Dr., Huntsville, AL (US) 35802

( * ) Notice: Subject to any disclaimer, the term of this patent is extended or adjusted under 35 U.S.C. 154(b) by 0 days.

(21) Appl. No.: 09/515,054

(22) Filed: Feb. 28, 2000

(51) Int. Cl.[7] ..... A47K 13/10
(52) U.S. Cl. ..... 4/246.1; 16/905
(58) Field of Search ..... 4/246.1, 246.2, 4/246.3, 234, 237; 16/905

(56) References Cited

U.S. PATENT DOCUMENTS

| | | |
|---|---|---|
| 723,973 | 3/1903 | Alexander . |
| 2,318,518 | 5/1943 | Opperer . |
| 3,717,884 | 2/1973 | Mantooth . |
| 4,512,046 | 4/1985 | Riggle . |
| 4,519,105 | 5/1985 | Blanck . |
| 4,562,601 | 1/1986 | Aflitto . |
| 4,574,401 | 3/1986 | Nakajima . |
| 4,763,362 | 8/1988 | Eure . |
| 4,839,928 | 6/1989 | Probasco . |
| 4,843,656 | 7/1989 | Forman . |
| 5,435,016 | 7/1995 | Smith et al. . |
| 5,459,889 | 10/1995 | Jamison . |
| 5,689,838 | 11/1997 | MacKenzie . |
| 5,771,502 | 6/1998 | O'Grady . |
| 5,870,015 | 2/1999 | Hinkel . |
| 5,937,449 | 8/1999 | Rey . |

*Primary Examiner*—Henry J. Recla
*Assistant Examiner*—Huyen Le
(74) *Attorney, Agent, or Firm*—Wood, Herron & Evans, L.L.P.

(57) ABSTRACT

A toilet seat accessory mounted to the toilet seat cover and having a blocking device extending beyond a perimeter of the cover to block access to a flush handle of the toilet when the cover is in the raised position. A latching device on the accessory removably latches to the seat such that as the cover is moved between the raised and lowered positions, the seat is held by the opposite end of the toilet seat accessory and moves with the cover between the raised and lowered positions. The latching device has a tab connected with the latching device, whereby upon the cover and seat being in the raised position, pushing on the tab removes the latching device from the seat, thereby releasing the seat from being latched with the cover.

22 Claims, 3 Drawing Sheets

TOILET ACCESSORY

FIELD OF THE INVENTION

This invention relates generally to the field of appliances and, more particularly, to a toilet seat attachment.

BACKGROUND OF THE INVENTION

Conventional toilets include a lower bowl portion having an opening that is covered by a hinged seat and cover. The seat and cover are manually moved or pivoted between a generally horizontal lower position and generally vertical raised position. The cover and seat are moved separately or together at the choice of the user. The movable seat permits females to use the appliance in the seated position and males to use the appliance in a standing position. The cover is raised for use and lowered to provide a more pleasing appearance when the appliance is not in use.

As with so many other seemingly simple appliances, significant difficulties arise because many males will urinate from the standing position without raising the seat, thereby leaving the seat soiled. Soiling of the toilet seat can lead to bacterial growth on the seat and the possibility of disease being spread through human contact therewith. Females obviously find such a situation to be repugnant and are forced to clean the seat prior to use. This difference in toilet use between the sexes and a lack of recognition of proper toilet etiquette on the part of many males has led to considerable controversy over the past century. A lack of proper toilet seat use also arises with younger males who have yet to learn or are in the process of learning the habit of raising and lowering the toilet seat.

In addition, leaving the toilet bowl uncovered after use often attracts a child or pet. The open toilet bowl permits children to throw items into the toilet and also encourages domestic pets to drink from the bowl. Further, an uncovered toilet bowl can result in an infant falling into the bowl and sustaining an injury or worse. Finally, an uncovered toilet bowl presents a less attractive appearance than a closed toilet bowl.

Thus, there is a need for a device that encourages males to lift the toilet seat prior to urinating from a standing position and thereafter, flush the toilet and lower the seat and cover after use. Further, the device must permit females to easily use the toilet seat without undue manipulation or inconvenience.

SUMMARY OF THE INVENTION

The present invention provides a toilet accessory that promotes a proper and sanitary use of a toilet by males and females alike. More specifically, the present invention is especially useful in the training of young males in the proper use of the toilet. The present invention assures that males using the toilet will not soil the toilet seat, that the toilet will be flushed after use and the seat and cover will be placed in a lowered position after use.

In accordance with the principles of the present invention and in accordance with the described embodiments, the present invention provides a toilet seat accessory for use with a seat and cover of a toilet that independently pivot between raised and lowered positions. The toilet seat accessory is mounted to the cover and has one end extending beyond a perimeter of the cover to block access to a flush handle of the toilet when the cover is in the raised position. An opposite end of the accessory is removably latched to the seat such that as the cover is moved between the raised and lowered positions, the seat is held by the opposite end of the toilet seat accessory and moves with the cover between the raised and lowered positions.

The toilet accessory of the present invention has proven to be useful in training young males in the proper use of the toilet. As such, the toilet accessory prevents the unnecessary soiling of the toilet seat and further, encourages the user to lower the seat and cover after use and flush the toilet. A lowered seat and cover blocks access by children and pets to the toilet bowl with an advantage of preventing blockage of the plumbing works by foreign objects that may be put in the toilet bowl by children. Blocking access to the toilet bowl has a further advantage of preventing pets from drinking from the bowl. Another advantage of a closed toilet bowl is that infants are prevented from accidentally falling into the bowl and sustaining a serious injury or drowning. A lowered seat and cover provides a still further advantage of providing a substantially improved appearance when the toilet is not in use. Thus, with the present invention, the toilet bowl is always in a desired covered state when not in use.

In one aspect of the invention, a blocking device is on the one end of the toilet seat accessory and has a broad substantially flat portion blocking access to the flush handle from all directions.

In a further aspect of the invention, a latching device is on the opposite end for removably latching onto the seat. The latching device includes a standoff extending outward from the cover and a hook is the distal end of the standoff, and the hook extends over an inner edge of the seat and contacts and hooks onto the lower seat surface, thereby releasably connecting the seat to the cover. A tab extends opposite the hook on the distal end of the standoff, whereby upon the cover and seat being in the raised position, pushing on the tab removes the hook from the lower surface of the seat, thereby releasing the seat from being latched with the cover.

In another embodiment of the invention, a toilet seat cover includes a blocking device extending beyond a perimeter of the cover, the blocking device being mounted at a location causing the blocking device to block access to a flush handle of the toilet when the cover is in the raised position. The cover further includes a latching device adapted to be removably latchable to a toilet seat such that as the cover is moved between the raised and lowered positions, the seat is held by the latching device and is moved with the cover between the raised and lowered positions.

These and other objects and advantages of the present invention will become more readily apparent during the following detailed description together with the drawings herein.

DETAILED DESCRIPTION OF THE INVENTION

Figure 1:
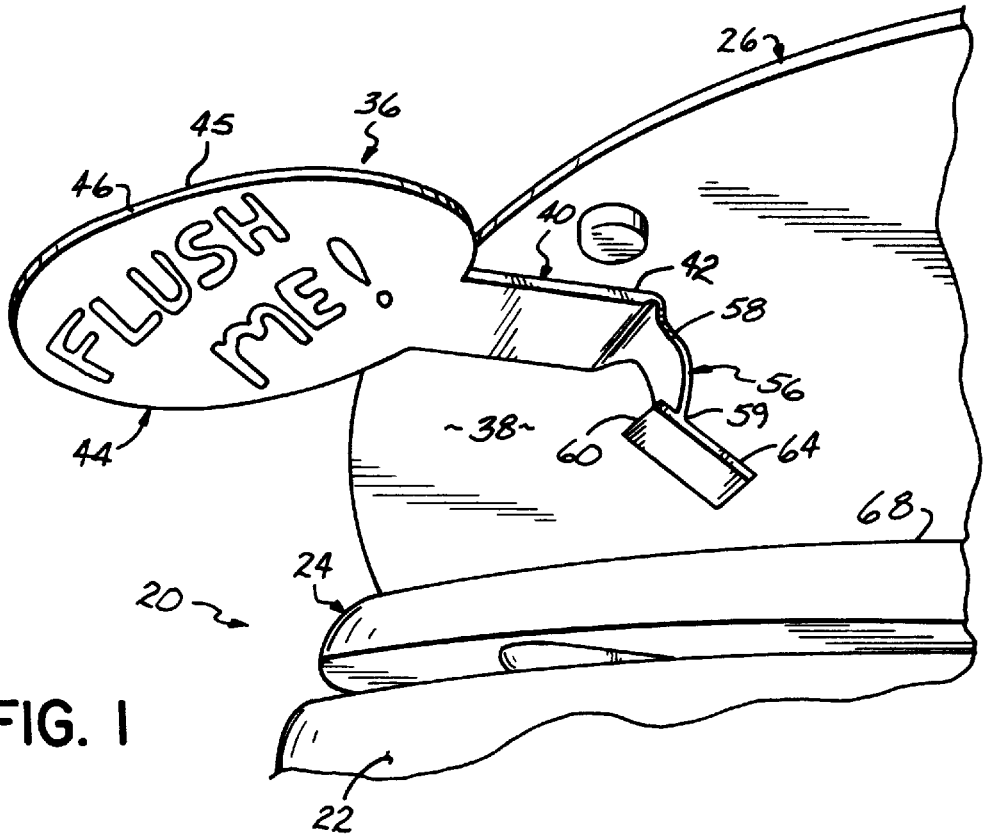
FIG. 1 is a partial perspective view of the toilet accessory with the cover and seat separated in accordance with the principles of the present invention.
Figure 3:
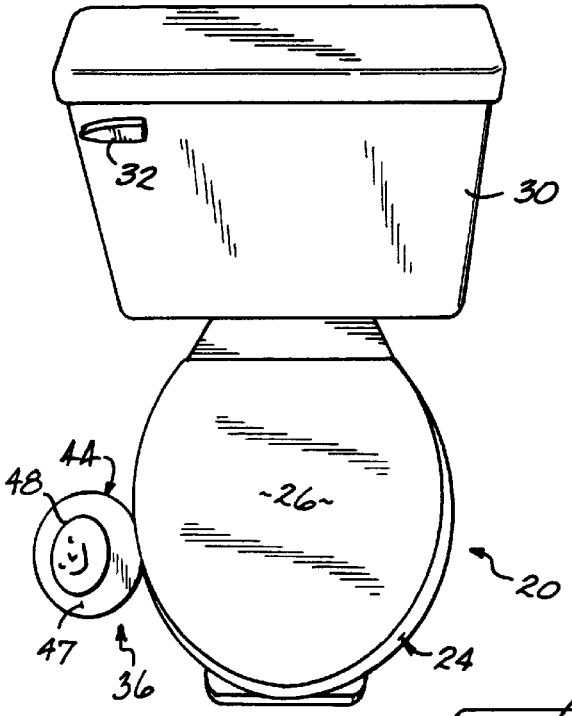
FIG. 3 is a perspective view of a toilet showing the toilet accessory of FIG. 1 with the cover and seat in the lowered position.

Referring to FIG. 1, a toilet 20 includes a toilet bowl 22, a toilet seat 24 and a toilet seat cover 26. As further illustrated in FIG. 4, the toilet 20 is of a well known construction in which the seat 24 and cover 26 are independently, pivotally mounted to the bowl 22 by means of a pair of hinges 28. Thus, the seat 24 and cover 26 are moveable, either independently or together, between a generally vertical raised position illustrated in FIG. 4 and a generally horizontal lowered position as illustrated in FIG. 3. The toilet 20 further includes a tank 30 and a flush handle 32 that is operated to flush the contents from the bowl 22 utilizing clean water stored in the tank 30.

Referring to FIG. 1, a toilet accessory 36 is attached to a lower surface 38 of the cover 26. The toilet accessory 36 has a base portion 40 having a generally flat surface 42 in juxtaposition with the lower surface 38 of the cover. The base portion 40 of the toilet accessory 36 is either permanently or removably attached to the cover in any known manner, for example, by using adhesive, double sided tape, velcro, mechanical fasteners such as screws, or any other attaching, connecting or fastening apparatus.

Figure 4:
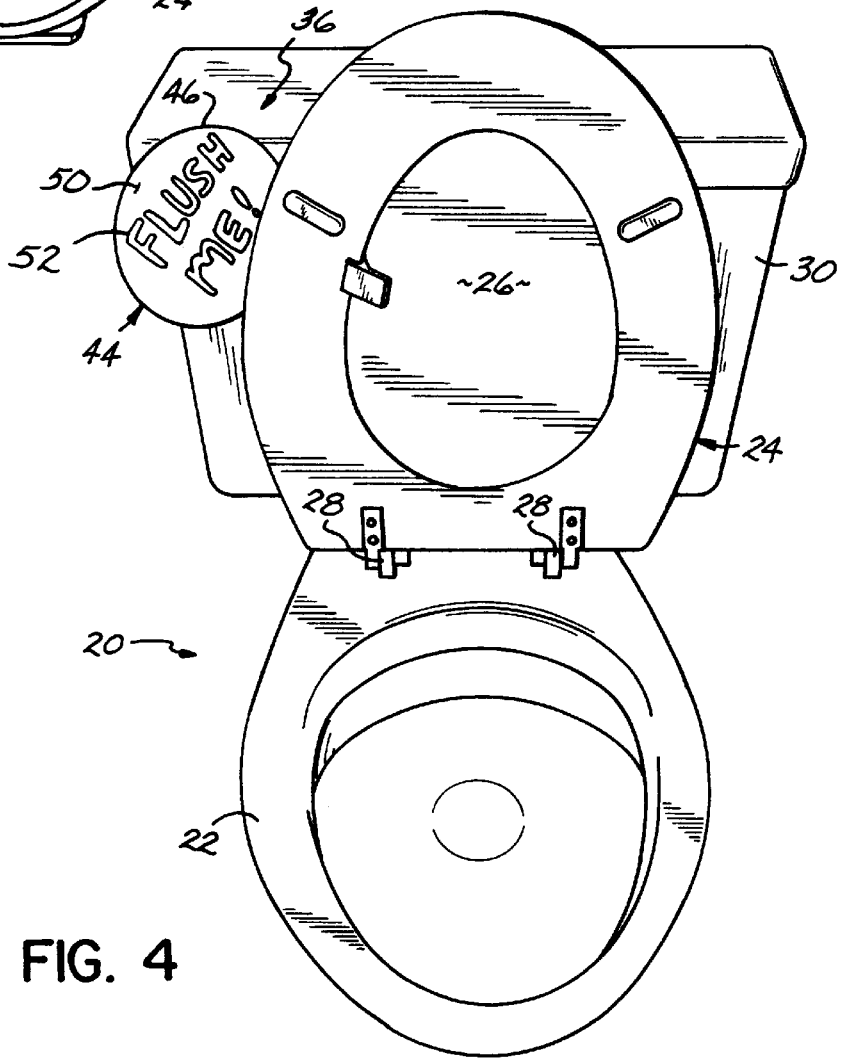
FIG. 4 is a perspective view of a toilet showing the toilet accessory of FIG. 1 with the cover and seat in the raised position.

The toilet accessory 36 includes a blocking device 44 connected to one end of the base portion 40. The toilet accessory 36 is attached to the lower surface 38 of the cover 26 at a location such that when the toilet cover 26 is in the raised position, as illustrated in FIG. 4, the blocking device 44 covers the flush handle 32. Normally, the toilet accessory 36 is located such that the flush handle 32 is centrally located behind the blocking device 44 when the cover 26 is in the raised position. The blocking device 44 has a broad substantially flat portion 45 with a curved perimeter 46. Referring to FIG. 3, the blocking device 44 has a first surface 47 that is viewable by the user of the toilet 20 when the cover 26 is in the lowered position. The first surface 47 includes indicia 48 that normally is a graphical representation of a known and interesting image, for example, a smilely face, cartoon character, a doll image, etc. Normally the image is one that draws the attention of the user, especially younger children. Referring to FIG. 4, the blocking device 44 has a second surface 50 on its opposite side that also includes indicia 52 that is viewable by the user when the cover 26 is in the upper position. The indicia 52 is normally a statement or instruction, for example, "Flush Me!".

Referring to FIG. 1, the toilet accessory 36 further includes a latching device 56. The latching device 56 has a standoff 58 extending outwardly away from the lower surface 38 of the seat 26. Normally, the standoff 58 extends out at an angle of approximately 90° with respect to the lower surface 38. The standoff 58 has a hook 60 at its distal end that extends in a generally radial outward direction. Thus, referring to FIG. 2, the hook 60 extends toward an inner edge 62 of the seat 24. A tab 64 is also connected to the distal end 59 of the standoff 58. The tab 64 extends in a direction opposite that of the hook 60, and thus, the standoff 58, hook 60 and tab 64 are generally T-shaped. The accessory 36 is normally molded, for example, injection molded, from a plastic material, for example, polypropylene. Therefore, the standoff 58 is able to flex from its illustrated position. The rigidity of the other portions of the toilet accessory 36 will depend on its thickness which is a design decision based on strength and cost factors.

Figure 2:
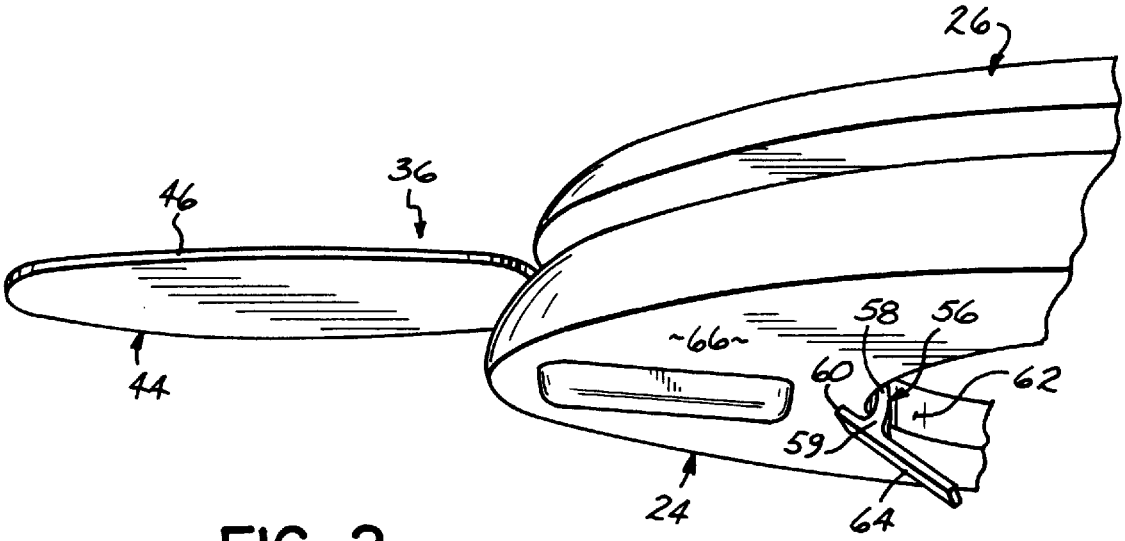
FIG. 2 is a partial perspective view of a toilet showing how the toilet accessory of FIG. 1 latches the seat to the cover.

Normally, the toilet seat 24 and cover 26 are in their generally horizontal, lowered position illustrated in FIGS. 2 and 3. As shown in FIG. 2, when in the lowered position, the hook 60 of the latching device 56 extends around the inner edge 62 and hooks over and contacts the lower surface 66 of the seat 24. Thus, the seat 24 and cover 26 are releasably connected and held together by the latching device 56 of the toilet accessory 36. If a male desires to use the toilet 20, preferably, the seat 24 and cover 26 should be raised. However, without the toilet accessory 36, it is possible for only the cover 26 to be raised, thereby resulting in the top surface 68 of the seat 24 being soiled by the male urinating from a standing position. However, with the toilet accessory 36, any attempt to lift the cover 26 from its lowered position will result, because of the latching device 56, in the toilet seat 24 also being raised. Thus, the seat 24 and cover 26 will be in the raised position illustrated in FIG. 4, and use of the toilet by a standing male will not soil the seat 24.

When in the raised position, the blocking device 44 has indicia 52 reminding the user that the toilet should be flushed. However, since the blocking device covers the flush handle 32, it is necessary for the user to lower the seat 24 and cover 26 in order to gain access to the flush handle 32. Again, because the latching device 56 holds the seat 24 and cover 26 together, any attempt to lower the seat 24 will also result in the cover 26 being lowered. When in the lowered position, as illustrated in FIG. 3, the flush handle 32 is accessible for use. Further, the seat 24 and cover 26 are in the desired lowered position when the toilet 20 is not in use.

To accommodate users who wish to use the seat 24, as previously described, the seat 24 and cover 26 are moved to the upper position illustrated in FIG. 4. The user then depresses the tab 64 to release the hook 60 from the lower surface 66 of the toilet seat 24. When the latching device 56 is released, the toilet seat 24 is then moved independently of the cover 26 to the desired lowered position for seated users. After use, the blocking device 44 requires that the cover 26 also be lowered in order to gain access to the flush handle. As the cover 26 is lowered onto the seat 24, the hook 60 of the latching device 56 again hooks over the lower surface 66 of the seat 24.

The toilet accessory 36 of the present invention has proven to be useful in training young males in the proper use of the toilet. As such, the toilet accessory prevents the unnecessary soiling of the toilet seat and further, encourages the user to lower the seat 24 and cover 26 after use and thereafter, flush the toilet.

The toilet accessory of the present invention has proven to be useful in training young males in the proper use of the toilet. As such, the toilet accessory prevents the unnecessary soiling of the toilet seat and further, encourages the user to lower the seat and cover after use and flush the toilet. Lowering the seat and cover to block access by children and pets to the toilet bowl has the advantages of preventing blockage of the plumbing works by foreign objects that may be put in the toilet bowl by children, preventing pets from drinking from the bowl, preventing infants from accidentally falling into the bowl, and providing a substantially improved appearance when the toilet is not in use. Thus, with the present invention, the toilet bowl is always in a desired covered state when not in use.

Figure 5:
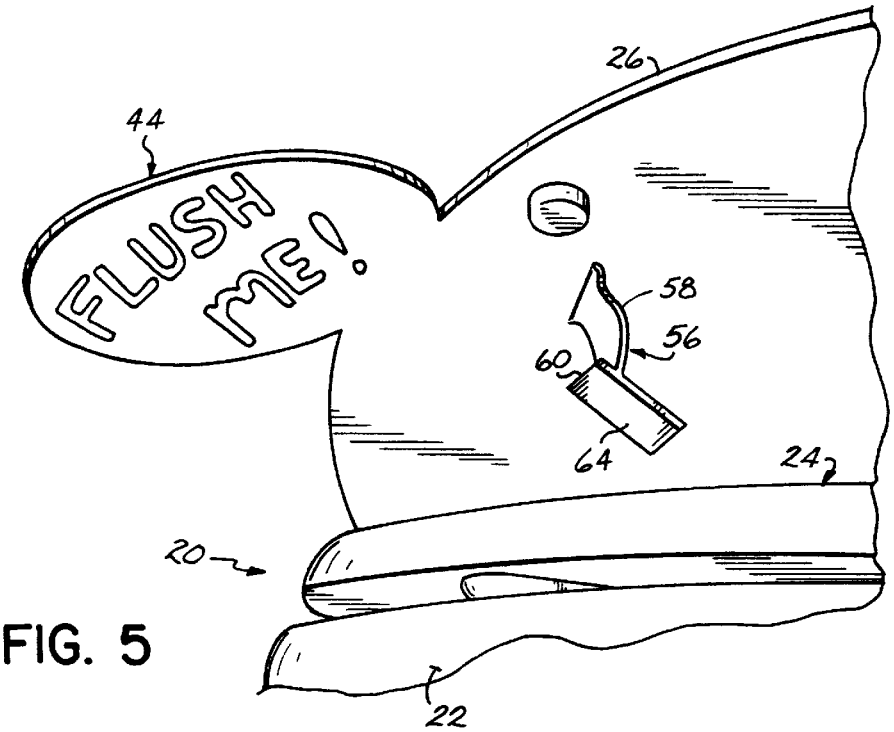
FIG. 5 is a partial perspective view of an alternative embodiment of the toilet accessory shown in FIG. 1.

While the invention has been set forth by a description of one embodiment in detail, it is not intended to restrict or in any way limit the claims to such detail. Additional advantages and modifications will readily appear to those who are skilled in the art. For example, in the described embodiment, the toilet accessory 36 is illustrated as an attachment to a toilet 20. Referring to FIG. 5, as will be appreciated, the blocking device 44 and latching device 56 may be formed or manufactured integral with the cover 26. Thus, the latching device 56 may be provided at a different location on the cover 26 from the blocking device, for example, more forward or on the opposite side of the cover 26.

Figure 6:
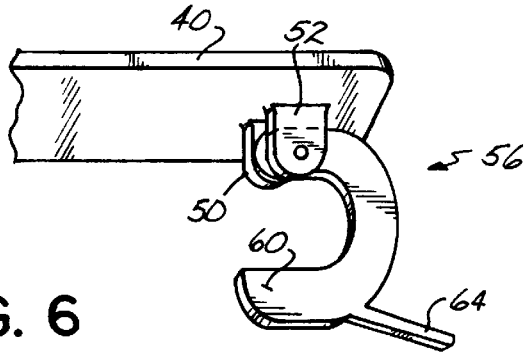
FIG. 6 is a partial perspective view of an alternative embodiment of a latching device of the toilet accessory illustrated in FIG. 1.

The latching device 56 of FIG. 1 is illustrated as a flexible member made of a nonrigid material. As will be appreciated, referring to FIG. 6, the latching device 56 may be a generally C-shaped and rigid device which is pivotally attached to the base portion 40 or, alternatively, directly to the lower surface 38 of the cover 26. The latching device 56 is pivotally mounted between blocks 50, 52, and a spring (not shown) is utilized to bias the latching device 56 in the clockwise direction as illustrated in FIG. 6. The latching device 56 includes a hook 60 and tab 64 that operate as previously described.

Figure 7:
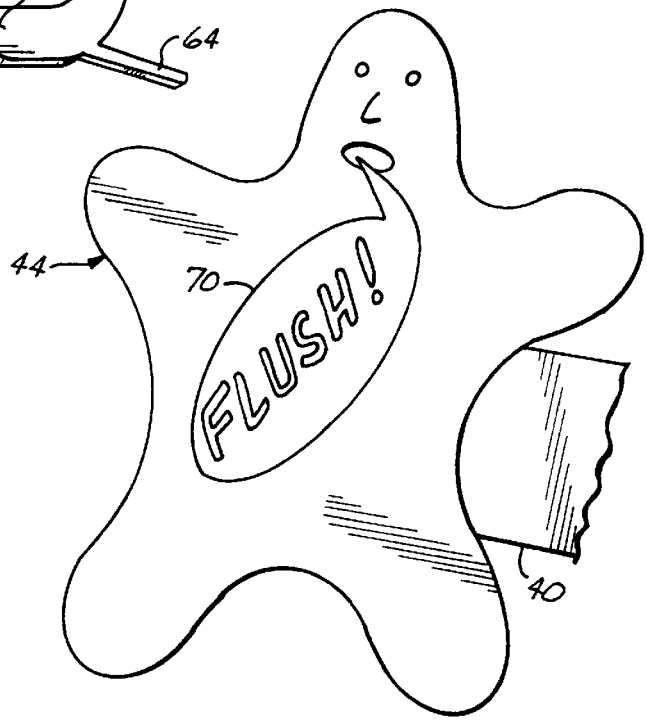
FIG. 7 is a partial plan view of an alternative embodiment of the blocking device of the toilet accessory illustrated in FIG. 1.

FIG. 7 illustrates an alternative embodiment of the blocking device 44. As will be appreciated, the blocking device 44 can have any desired shape, and the perimeter of the blocking device may be comprised of all curved lines, a combination of curved and straight lines or a combination of all straight lines. The indicia 70 may be of any type that encourages proper use of the toilet.

While the toilet accessory 36 is described as being made from a plastic material, as will be appreciated, other materials such a fibrous material, pressed paper, sheet metal, etc. or a combination of those materials may be used. Further, the different parts of the toilet accessory may be made of different materials and/or have different strengths and rigidity. As will further be appreciated, the toilet accessory or a part of it may be of a flourescent type of material such that the user is attracted to the accessory device in the dark and its use is thereby encouraged.

Therefore, the invention in its broadest aspects is not limited to the specific detail shown and described. Consequently, departures may be made from the details described herein without departing from the spirit and scope of the claims which follow.

What is claimed is:

1. An apparatus for use with a toilet having a seat and cover that independently pivot with respect to a bowl between raised and lowered positions, the apparatus comprising a toilet seat accessory adapted to be mounted to the cover and having one end extending beyond a perimeter of the cover to block access to a flush handle of the toilet when the cover is in the raised position, and the toilet seat accessory having a latching device attached to an opposite end adapted to be removably latched to an inner edge of the seat such that as the cover is moved between the raised and lowered positions, the seat is held by the opposite end of the toilet seat accessory and moves with the cover between the raised and lowered positions.

2. The apparatus of claim 1 further comprising a blocking device on the one end of the toilet seat accessory for blocking access to a flush handle.

3. The apparatus of claim 2 wherein the blocking device has a broad substantially flat portion blocking access to the flush handle from all directions.

4. The apparatus of claim 3 wherein the broad flat portion has a substantially curved perimeter.

5. The apparatus of claim 4 wherein the first surface of the blocking device has indicia.

6. The apparatus of claim 4 wherein the second surface of the blocking device has indicia reminding a user to flush the toilet.

7. The apparatus of claim 6 further comprising a base extending between the latching device and the blocking device, the base adapted to be mounted on the cover.

8. The apparatus of claim 7 wherein the cover has a lower surface and the base is adapted to be mounted to the lower surface of the cover.

9. The apparatus of claim 3 wherein the broad flat portion of the blocking device has a first surface adapted to face a user when the cover is in the lowered position.

10. The apparatus of claim 3 wherein the broad flat portion of the blocking device has a second surface adapted to face a user when the cover is in the raised position.

11. The apparatus of claim 1 wherein the latching device is flexible.

12. The apparatus of claim 1 wherein the latching device extends outward at an angle with respect to the cover.

13. The apparatus of claim 12 wherein the latching device has a standoff extending outward from the cover and the standoff portion has a hook on its distal end.

14. The apparatus of claim 13 wherein the standoff extends outward from the cover at an angle of approximately 90°.

15. The apparatus of claim 14 wherein the seat has an inner opening bounded by an inner edge defining an intersection between an upper seat surface and a lower seat surface, and upon the cover being in the lowered position, as the seat is moved to the lowered position, the hook extends over the inner edge, contacts and hooks onto the lower seat surface, thereby releasably connecting the seat to the cover.

16. The apparatus of claim 15 wherein latching device includes a tab, whereby upon the cover and seat being in the raised position, pushing on the tab removes the hook from the lower surface of the seat, thereby releasing the seat from being latched with the cover.

17. The apparatus of claim 16 wherein the tab is connected to the distal end of the standoff.

18. The apparatus of claim 17 wherein the hook extends in a first direction from the standoff and the tab extends in an opposite direction from the standoff.

19. The apparatus of claim 18 wherein the latching device with the tab is generally T-shaped.

20. An apparatus for use with a toilet having a seat and cover that independently pivot with respect to a bowl between raised and lowered positions, the seat having an inner opening bounded by an inner edge defining an intersection between a curved upper seat surface and a substantially flat lower seat surface, the apparatus comprising:

a blocking device adapted to be mounted on the cover and extending beyond a perimeter of the cover, the blocking device being mounted at a location causing the blocking device to block access to a flush handle of the toilet when the cover is in the raised position; and a latching device adapted to be mounted on the cover and adapted to be removably latchable to the inner edge of the seat such that as the cover is moved between the raised and lowered positions, the seat is held by the latching device and is moved with the cover between the raised and lowered positions.

21. A toilet seat accessory for use with a toilet having a seat and cover that independently pivot with respect to a bowl between raised and lowered positions, the toilet seat accessory comprising:

a base portion adapted to be mounted to the cover;

a blocking portion connected to one end of the base portion and extending beyond a perimeter of the cover to block access to a flush handle of the toilet when the cover is in the raised position; and a latching portion connected to an opposite end of the base portion and adapted to be removably connected to the seat such that as the cover is moved between the raised and lowered positions, the seat is held by the latching portion and moved with the cover between the raised and lowered positions.

22. A toilet seat cover for use with a toilet having a seat that independently pivots with respect to a bowl between raised and lowered positions, the toilet seat cover comprising:

a cover pivotally connected to the bowl and movable between raised and lowered positions, the cover including a blocking device extending beyond a perimeter of the cover, the blocking device being mounted at a location causing the blocking device to block access to a flush handle of the toilet when the cover is in the raised position; and a latching device adapted to be removably latchable to an inner edge of the seat such that as the cover is moved between the raised and lowered positions, the seat is held by the latching device and is moved with the cover between the raised and lowered positions.

* * * * *